US010227211B2

(12) United States Patent
Lyons et al.

(10) Patent No.: US 10,227,211 B2
(45) Date of Patent: Mar. 12, 2019

(54) COMBINED STAIRWAY AND LIFT INSTALLATION AND METHOD FOR CONVERTING SAID STAIRWAY INTO SAID LIFT

(71) Applicants: Steven James Lyons, Ashford (GB); Charles Thomas Lyons, Staines (GB)

(72) Inventors: Steven James Lyons, Ashford (GB); Charles Thomas Lyons, Staines (GB)

( * ) Notice: Subject to any disclaimer, the term of this patent is extended or adjusted under 35 U.S.C. 154(b) by 0 days.

(21) Appl. No.: 14/391,205

(22) PCT Filed: Apr. 12, 2013

(86) PCT No.: PCT/GB2013/050953

§ 371 (c)(1),
(2) Date: Oct. 8, 2014

(87) PCT Pub. No.: WO2013/156761

PCT Pub. Date: Oct. 24, 2013

(65) Prior Publication Data

US 2015/0068846 A1 Mar. 12, 2015

(30) Foreign Application Priority Data

Apr. 16, 2012 (GB) ..... 1206601.5

(51) Int. Cl.
*B66B 9/08* (2006.01)
*E04F 11/02* (2006.01)
*E04F 11/06* (2006.01)

(52) U.S. Cl.
CPC ..... *B66B 9/0869* (2013.01); *E04F 11/06* (2013.01); *E04F 2011/0203* (2013.01)

(58) Field of Classification Search
CPC ..... B66B 9/08; B66B 9/0869; E04F 11/06; E04F 11/062; E04F 11/064; E04F 2011/0203
See application file for complete search history.

(56) References Cited

U.S. PATENT DOCUMENTS 2,740,165 A * 4/1956 Ward ..... A63J 1/00 52/126.1
3,913,497 A * 10/1975 Maroshick ..... B61D 23/02 105/447

(Continued)

FOREIGN PATENT DOCUMENTS

CN 201338894 Y 11/2009
DE 10 2007 018756 10/2008

(Continued)

OTHER PUBLICATIONS

European Patent Application No. 13 718 883.5 Examination Report dated May 6, 2016.

(Continued)

*Primary Examiner* — Minh Truong
(74) *Attorney, Agent, or Firm* — Woodard, Emhardt, Henry, Reeves & Wagner, LLP; Charles Meyer

(57) ABSTRACT

A stairway (1) comprising a plurality of steps (2) each defining a top surface or tread (3) is converted into a lift platform by employing a mechanism concealed beneath an envelope defined by the treads of all of the steps to guide each step of the plurality vertically from a stairway configuration in which the steps form a stairway enabling access from a lower (7) level to an upper level (8) to a flat configuration in which the top edge of each step is substantially in a horizontal plane level with one of the lower and upper levels from which a wheelchair user may wish to travel to the other of the lower and upper levels. As a result, a wheelchair user may move horizontally from the said one of the lower and upper levels on to a platform defined by the top edges of the plurality of steps in the flat configuration. The stairway and flat configurations occupy the same footprint.

14 Claims, 5 Drawing Sheets

(56) References Cited

U.S. PATENT DOCUMENTS

| | | | | |
|---|---|---|---|---|
| 4,100,995 | A | 7/1978 | Pradon | |
| 4,168,764 | A * | 9/1979 | Walters | B63B 27/14 182/1 |
| 4,457,402 | A * | 7/1984 | Del Vecchio | A61G 3/06 105/449 |
| 4,583,466 | A * | 4/1986 | Reddy | B61D 23/02 105/443 |
| 5,234,078 | A * | 8/1993 | Smith | B66B 9/0869 187/200 |
| 5,632,357 | A * | 5/1997 | Matre | B64C 1/24 187/200 |
| 5,657,832 | A * | 8/1997 | Stevens | B63B 27/14 182/1 |
| 5,901,813 | A | 5/1999 | Orgal | |
| 5,937,971 | A | 8/1999 | Storm | |
| 8,807,283 | B2 * | 8/2014 | Shell | B66B 9/0869 182/1 |
| 9,091,083 | B1 * | 7/2015 | Goudreau | E04F 11/066 |
| 2011/0139544 | A1 * | 6/2011 | Frick | E04F 11/002 182/27 |

FOREIGN PATENT DOCUMENTS

| | | | |
|---|---|---|---|
| DE | 10 2010 005298 | A1 | 1/2010 |
| EP | 0759005 | | 2/1997 |
| FR | 2 723 578 | A1 | 2/1996 |
| GB | 2474584 | A | 4/2001 |
| JP | 119631 | A | 1/1999 |
| WO | WO 1999/02443 | A1 | 1/1999 |

OTHER PUBLICATIONS

International Application No. PCT/GB2013/050953 International Preliminary Report on Patentability dated Oct. 21, 2014.

Great Britian Application No. 1306712.9 International Search Report dated Oct. 2, 2013.

International Application No. PCT/GB2013/050953 International Search Report and Written Opinion dated Aug. 1, 2013.

Great Britian Application No. 1306712.9 Examination Report dated May 19, 2016.

European Patent Application No. 13 718 883.5 Examination Report dated Feb. 22, 2017.

* cited by examiner

COMBINED STAIRWAY AND LIFT INSTALLATION AND METHOD FOR CONVERTING SAID STAIRWAY INTO SAID LIFT

BACKGROUND

This disclosure relates to combined stairway and lift installations.

The term "stair" is commonly used to refer to a single step in a stairway within a building, the whole flight of a stairway within a building being referred to as "the stairs" or as a "staircase", while the term "steps" may refer to individual "stairs" or to the stairway as a whole in the case of an external stairway to a building or to a stairway within a garden or urban landscape. For convenience and consistency, hereafter, the term "step" is used to refer to an individual step or stair, and "stairway" to refer to a whole flight of such steps, whether internal or external.

It is often required for public buildings, which may have one or more steps at their main entrance, to provide access to wheelchair users. It may also be desirable to provide easier access for prams and pushchairs than attempting to man-handle them up an existing stairway. Access problems may arise not only on entering a building but also between levels within a building.

The simplest way to provide this access is to provide a ramp alongside any stairway. While this will obviously work it is not always a practical solution. Having both a ramp and a stairway takes up a large amount of space, which may not be available. Additionally if the access is being provided to a building of historical or architectural merit it may be undesirable (or, in some jurisdictions, illegal or unlawful) to build a ramp as this will change the external appearance of the building. As an alternative to a stairway inside a building, conventional lifts (elevators) have been provided. In the case of a building of historical or architectural merit, it may not readily be feasible at a later date to incorporate a conventional lift within the existing interior structure of the building without significant alteration to the interior fabric of the building.

EP0912809 Lyons provides a solution to this problem in which steps forming a stairway are horizontally retractable and positioned over a lift platform. Accordingly, as the steps are retracted horizontally, a lift platform is revealed. Following operation of the lift platform to move a wheelchair user from one level to another and return of the platform to its original position, the steps return to their original position, so that the stairway may be used by able-bodied users in conventional fashion. Practical embodiments of this stairway/lift platform system, supplied by Sesame Access Ltd of West Byfleet, Surrey KT14 7LF, have proved very successful. However, this existing system requires space behind the stairway into which individual steps of the stairway may retract. There may not always be sufficient space behind an existing stairway to accommodate such retraction. This space may already contain load bearing members and/or utilities.

At the date of filing the present application, Applicant is aware of two more recent developments as follows, neither of which is entirely successful, for the reasons explained:

A combined stairway and platform lift is supplied by Terry Group Ltd of Knutsford, Cheshire WA16 8PR under the trade designation TSL1000 Domestic Steplift, for which, at the date of filing this application, pictures and a video were available at www.terrylifts-.co.uk/ts11000-steplift.html illustrating how this stairway/lift works. A lift platform is provided in front of the stairway. A wheelchair user wheels their wheelchair up a short ramp onto the platform. As the platform rises vertically, individual steps also rise guided by vertically extending railings provided on either side of the stairway until both the platform and the treads of the individual steps all lie in the plane of an upper surface level onto which the wheelchair user may then travel. While this structure need not intrude into space behind the stairway, it requires additional space in front of the stairway and provision of intrusive vertical railings on either side of the stairway. This structure is unlikely to find favour for incorporation into buildings of historical or architectural merit.

An alternative combined stairway and platform lift is made by a company called Swallow Evacuation & Mobility Products Ltd of Birmingham B14 7QQ under the Trademark Flexstep and can be seen in a video at www.youtube.com/watch?vQNoA6LFNPh0. In this model the steps sweep forward as they are lowered to create a flat platform which may be used as a lift. Due to the sweeping motion an overhang is left at the forward edge, which can be inconvenient for wheelchair users. Additionally due to the sweeping motion it would not be possible for the steps to have risers. Particularly when placed outside, risers are desirable in a stairway, since, in addition to giving the stairway a desirable aesthetic appearance they also serve largely to prevent items, such as leaves getting trapped under the stairway and potentially clogging the mechanism.

SUMMARY OF THE DISCLOSURE

The current disclosure arises from our work seeking to provide a novel solution to the provision of combined stairway and lift platform installations that avoids the problems inherent in the aforesaid previously proposed systems.

In accordance with a first aspect of the present disclosure, there is provided a combined stairway and lift installation, comprising: a plurality of movable steps each including a top surface or tread, the steps being capable of being positioned in a first stairway configuration to provide access from a lower level to an upper level for a person walking up the stairway; and a mechanism concealed beneath an envelope defined by the treads of all of the steps and capable of guiding the steps from the first stairway configuration to a flat configuration selected from a second flat configuration in which the top edges of all of the steps lie substantially in a common horizontal plane substantially level with the lower level and a third flat configuration in which the top edges of all of the steps lie substantially in a common horizontal plane substantially level with the upper level, with each step moving vertically from its position in the first stairway configuration to its position in the selected flat configuration, the mechanism being further capable of maintaining the top edges of the steps in a flat configuration while moving them together from the selected flat configuration to the other of the second and third flat configurations; and the second and third flat configurations having the same footprint as the first stairway configuration.

Preferred embodiments have one or more of the following features: The top surface or tread of each step defines a forward edge facing outwardly of the stairway and a rearward edge. Each step is supported adjacent respective lateral sides of the stairway by first and second movable stringers, and each step has a first follower constrained to follow the first stringer and a second follower constrained to follow the second stringer, the stringers and followers forming part of the mechanism. The first stringer is located vertically higher than the second stringer when the steps are in the first stairway configuration, the first follower associated with each step being more forwardly located than the second follower associated with the same step. Each stringer is of channel form, the followers being constrained within the channels. The first follower of the lowermost step is prevented from movement relative to the first stringer. The second follower of the uppermost step is prevented from movement relative to the second stringer, and the second stringer is mounted to a pivot on a bracket on the axis of the second follower of the uppermost step, the bracket being coupled to an hydraulic ram for movement of the bracket vertically to move the steps from their first stairway configuration to their second flat configuration with the tops of the steps level with the first level. Each step is supported on a pair of bearers, one located adjacent each lateral side of the stairway, each bearer mounting a first follower and a second follower thereon. Each bearer includes a rearward extension mounting a vertical pin which is slidably received through a guide opening in the bearer of the next higher step, the vertical pin having an upper portion accommodated in space beneath the tread and behind the riser of the next higher step as the steps move to the second flat configuration.

In an alternative arrangement, the first follower of the lowermost step is prevented from movement relative to the first stringer, the second follower of the uppermost step is prevented from movement relative to the second stringer, and the first stringer is mounted to a pivot on a bracket on the axis of the first follower of the lowermost step, the bracket being coupled to an hydraulic ram for movement of the bracket vertically to move the steps from the first stairway configuration to the third flat configuration with the tops of the steps level with the second level.

The combined stairway and lift installation may include at least one barrier hidden from view in the first stairway configuration but vertically raisable when the steps are in the second flat configuration with the tops of the steps level with the lower level, the at least one barrier comprising at least one of a barrier to the left of the flat configuration, a barrier to the right of the flat configuration and a barrier forwardly and outwardly of the stairway as a whole adjacent the forward edge of the lowermost step, the at least one barrier being raisable, together with the steps serving as a platform, from the second flat configuration to the third flat configuration in which the tops of the steps are level with the upper level.

In an alternative arrangement, the combined stairway and lift installation may include at least one barrier hidden from view in the first stairway configuration but vertically raisable when the steps are in the third flat configuration with the tops of the steps level with the upper level, the at least one barrier comprising at least one of a barrier to the left of the flat configuration, a barrier to the right of the flat configuration and a barrier forwardly and outwardly of the stairway as a whole adjacent the forward edge of the lowermost step, the at least one barrier being lowerable, together with the steps serving as a platform, from the third flat configuration to the second flat configuration in which the tops of the steps are level with the lower level.

The installation may further comprise an upper level barrier adapted to selectively prevent access from the upper level into a void defined above the steps in their second flat configuration or in configurations of the steps in which the top surfaces thereof serve together as a platform, which platform is located between the second and third flat configurations; the upper level barrier being selected from (i) a doorway mounted to swing about a vertical axis selectively to close off said void from access from the upper level and (ii) a raisable barrier located on said upper level and having a first position hidden from view beneath the upper level when the steps are in the first stairway configuration and a second raised position selectively closing off said void from access from the upper level when said void is present.

In accordance with a second aspect of the present disclosure, a method for converting a stairway comprising a plurality of steps each defining a top surface or tread into a lift platform comprises the steps of: employing a mechanism concealed beneath an envelope defined by the treads of all of the steps to guide each step of the plurality vertically from a stairway configuration in which the steps form a stairway enabling access from a lower level to an upper level to a flat configuration in which the top edge of each step is substantially in a horizontal plane level with one of the lower and upper levels from which a wheelchair user may wish to travel to the other of the lower and upper levels, whereby a wheelchair user may move horizontally from the said one of the lower and upper levels on to a platform defined by the top edges of the plurality of steps in the flat configuration, the stairway and flat configurations occupying the same footprint.

According a third aspect of the present disclosure, a method of moving a wheelchair user from a first level to a second level different from the first level comprises a first method step consisting of the aforesaid method for converting a stairway into a lift platform, followed by a second method step of moving the platform defined by the top edges of the plurality of steps as a whole vertically from the first level to the second level.

An optional additional method step can be performed at least before the second method step, the additional method step comprising raising at least one barrier from a position in which it is hidden from view in the stairway configuration, the at least one barrier comprising at least one of a barrier located to the left of the stairway, a barrier located to the right of the stairway, and a barrier forwardly and outwardly of the stairway as a whole.

The method may include a further method step of moving an upper level barrier to occupy a position preventing access from the upper level to a void defined above the steps when the steps occupy a configuration other than the stairway configuration and a flat configuration at the upper level.

BRIEF DESCRIPTION OF THE DRAWINGS

Reference may now be made to the description of preferred embodiments by way of example only with reference to the accompanying drawings, in which.

It will readily be appreciated that the drawings are somewhat schematic and that parts have been omitted in order to enable a better understanding both of the construction and operation of the installation as a whole.

DESCRIPTION OF PREFERRED EMBODIMENTS

Figure 1:
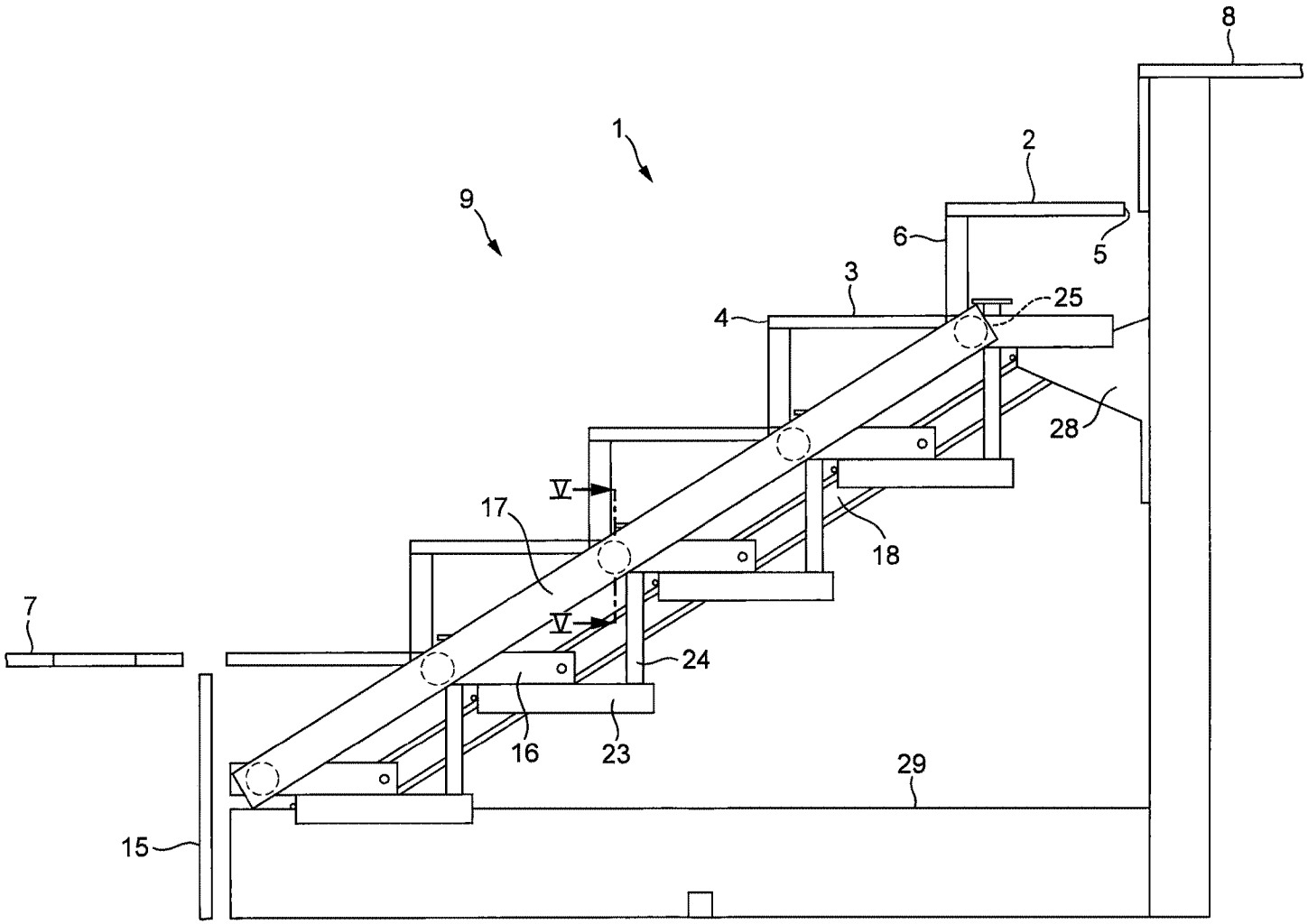
FIG. 1 is a side elevational view of a combined stairway and lift installation in a first stairway configuration.
Figure 3:
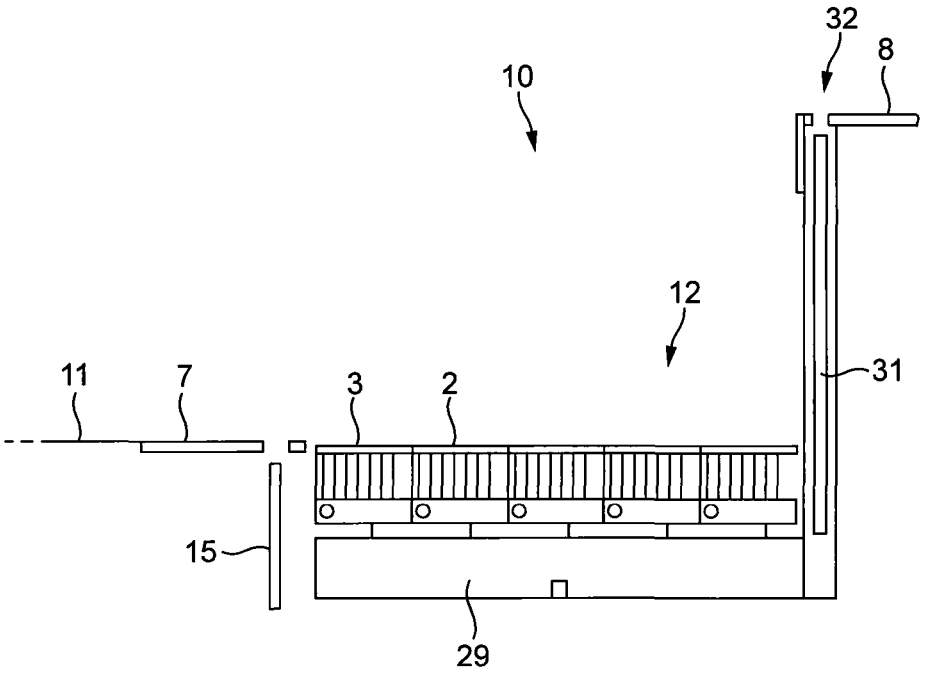
FIG. 3 is a side elevational view of the combined stairway and lift installation of FIGS. 1 and 2 in a second flat configuration level with a lower level.
Figure 4:
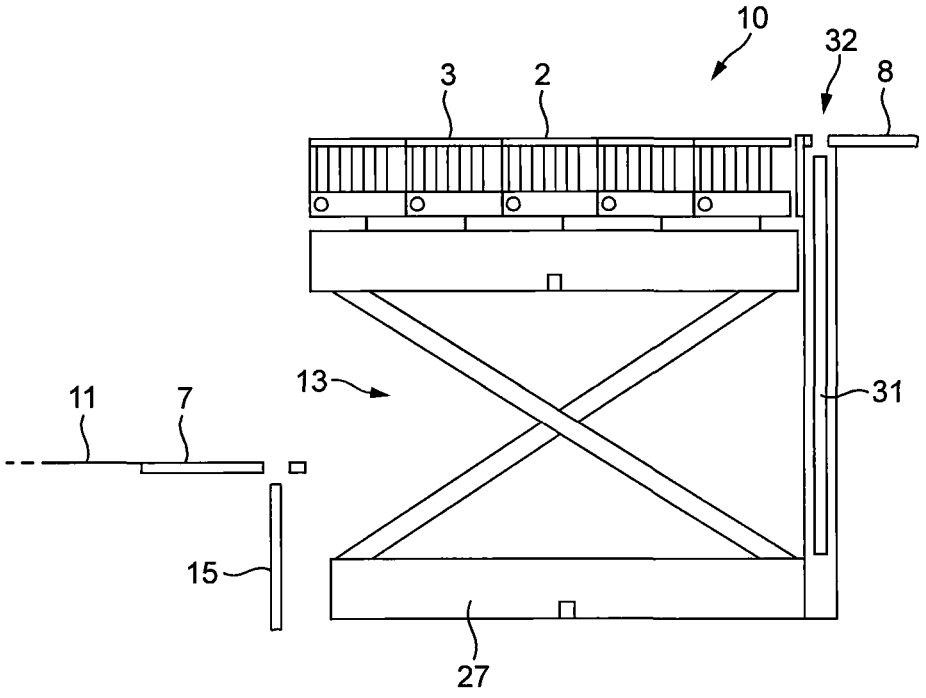
FIG. 4 is a side elevational view of the combined stairway and lift installation of FIGS. 1 to 3 in a third flat configuration level with an upper level.

Referring first to FIG. 1, a combined stairway and lift installation 1 includes a plurality of movable steps 2. Each step has a top surface or tread 3, a forward end 4 at the front of the top surface 3 facing outwardly of the stairway and a rearward end 5 at the rear of the top surface 3. As in any stairway, the several top surfaces or treads together effectively define an outer envelope for the stairway. A riser 6 is located beneath each step 2 other than the lowermost step at the forward end 4 of each tread. The combined stairway and lift installation 1 is used to provide access from a lower level 7 to an upper level 8 and vice versa. This can be achieved by a person walking up or down the stairway when the steps 2 are positioned in a first stairway configuration 9, as illustrated in FIG. 1. However, to enable wheelchair users or people with prams or pushchairs access, the stairway can convert into a flat platform configuration 10, as illustrated in FIGS. 3 and 4. The flat configuration 10 may comprise a flat platform configuration shown in FIG. 3 in which the top edges 3 of all of the steps 2 lie substantially in a horizontal plane 11 level with the lower level 7. In this configuration the steps effectively provide a lift platform 12 on to which a wheelchair or pram may be wheeled from the lower level 7 without necessarily needing a ramp, and which may be raised as a whole, as further explained below, to a level substantially level with upper level 8. The flat configuration may alternatively provide a lift platform 12 on to which a wheelchair or pram may be wheeled from the upper level 8 without necessarily needing a ramp, and which may be lowered as a whole, as further explained below, to a level substantially level with lower level 7.

This conversion is controlled by a mechanism 13, described in more detail below, which is concealed beneath an envelope effectively defined by the treads of the several steps 2. The mechanism 13 is capable of guiding the steps 2 from the staircase configuration 9 into the flat configuration 10 in a plane substantially level with the lower level 7, with each individual step moving vertically from its position in the stairway configuration to its position level with lower level 7, or alternatively to a position level with upper level 8. Barriers 14 hidden out of sight may be raised either side of the platform 12 when level with the lower level 7. A wheelchair user can then move from the lower level 7 on to the platform 12 and a further hidden barrier 15 (FIG. 1), positioned forwardly of the installation 1 adjacent the forward end of the lowermost step, can also be raised. The mechanism 13 raises platform 12 while maintaining the steps 2 in the flat configuration 10 until the platform occupies a flat configuration substantially level with the upper level 8, as shown in FIG. 4. The barriers 14, 15 preferably move with the platform. When the treads of the steps are level with upper level 8, the wheelchair user is able to move on to the upper level 8. The stairway and lift installation 1 can then be used by another user in its lift platform configuration wishing to go in either direction between levels 7 and 8 or can return to the staircase configuration 9. In an alternative arrangement a tray comprising wheel stop panels to the left, right and outward of the main part of the platform may be raised when a wheelchair user is located on the platform.

It will readily be appreciated that the steps may move from the stairway configuration into a flat platform configuration at the upper level and then be moved as a whole to the lower level.

Figure 2:
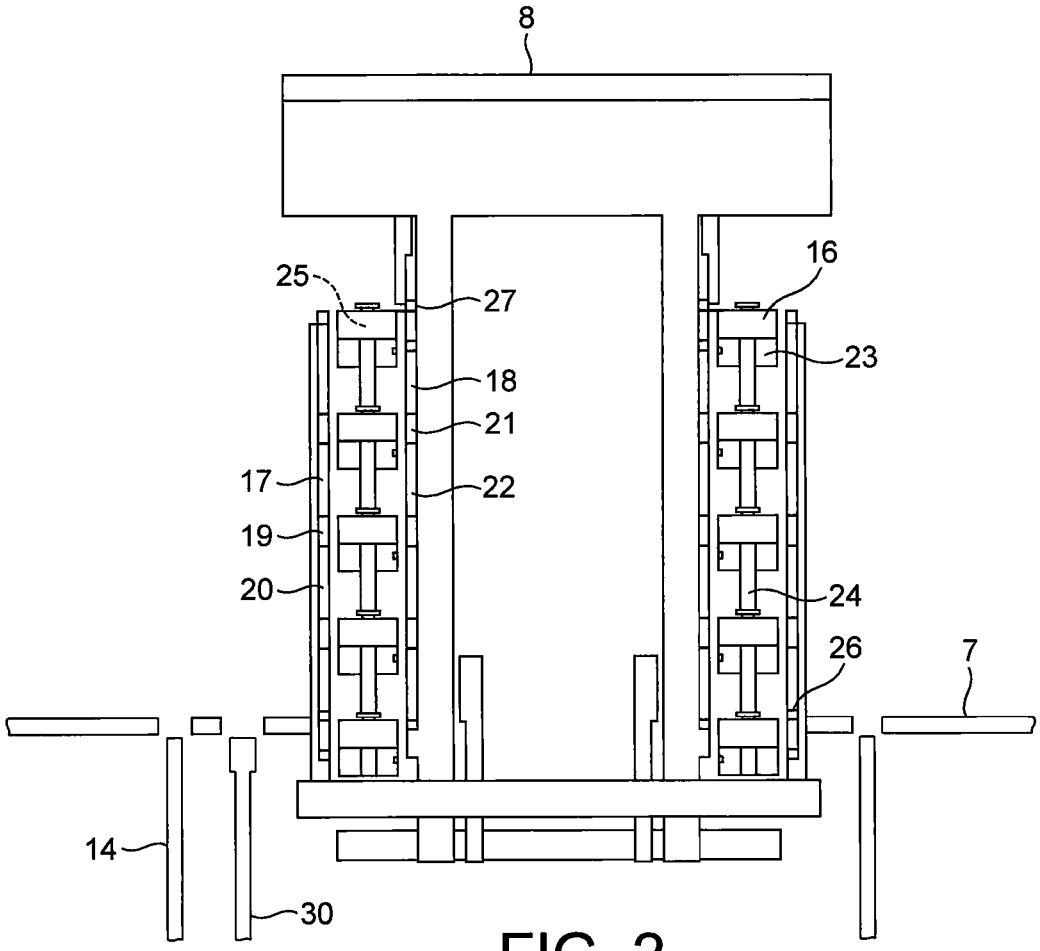
FIG. 2 is a front elevational view of the combined stairway and lift installation of FIG. 1 in the stairway configuration.
Figure 5:
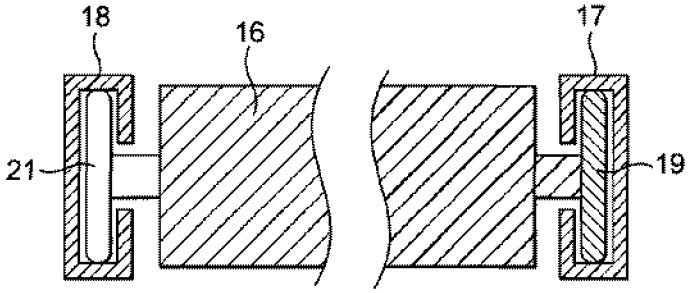
FIG. 5 is a sectional view of an individual bearer of the installation of FIGS. 1 to 4 and associated stringers, as seen along the line V-V in FIG. 1.
Figure 6:
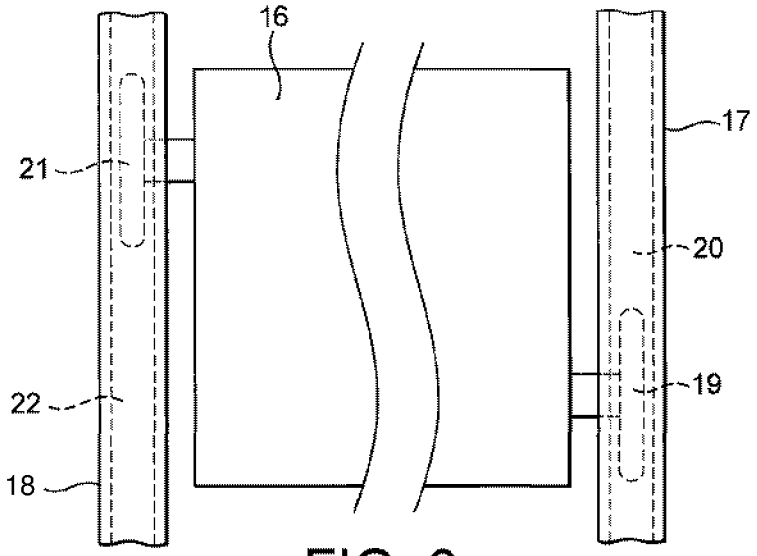
FIG. 6 is a view of the bearer of FIG. 5 and associated stringers as seen from above.
Figure 7A:
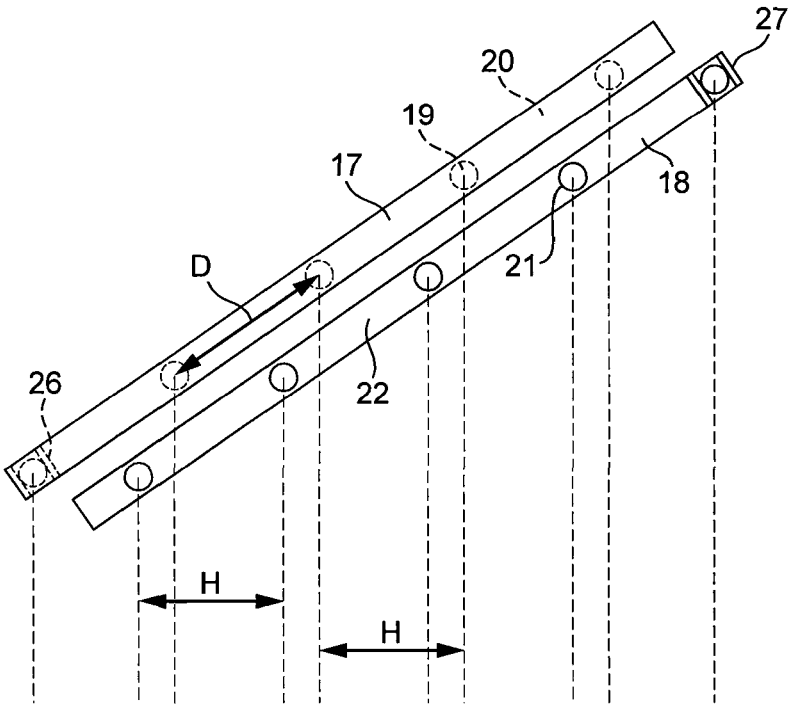
FIGS. 7*a* and 7*b* respectively show the stringers and followers in the first stairway configuration and in the second flat configuration in which the top edges of all the steps are substantially level with a lower level.
Figure 7B:
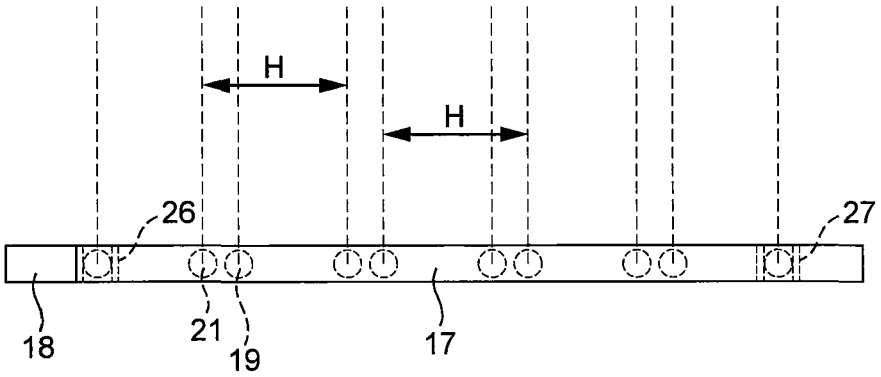

Each step 2, comprising a tread 3 and a riser 6, as shown in FIG. 1, is supported, preferably adjacent the respective lateral sides of the stairway, as shown in FIG. 2, by horizontal bearers 16, supported in turn by upper 17 and lower 18 stringers, best shown in FIGS. 1, 7*a* and 7*b*. Only the bearers and stringers associated with one lateral side of the stairway are shown in FIG. 1, it being understood that an exactly similar arrangement or its mirror image is provided adjacent the other lateral side of the stairway. Rather than being fixed, as in a static stairway, the stringers 17 and 18 form part of the mechanism 13. Each stringer is of generally channel form, being formed from an extruded section, as best shown in FIGS. 5 and 6. Each bearer 16 is provided with a first wheel or roller adjacent its forward edge which serves as a follower 19 within channel 20 defined by upper stringer 17, and with a second wheel or roller adjacent its rearward edge which serves as a follower 21 within channel 22 defined by lower stringer 18. It will readily be understood that when the steps form the platform configuration 10, all of the followers 19, 21 occupy the same level so that the upper and lower stringers 17, 18 must lie parallel to each other at the same level.

Referring again to FIG. 1, each bearer 16 includes an extension 23 rearwardly thereof, the rearward extension 23 mounting a vertical pin 24 which extends through a guide opening 25 in the bearer next above. As the steps move from the stairway configuration shown in FIG. 1 to the platform configuration substantially level with lower level 7, each pin rise through its associated guide opening into space beneath the tread of the step next above. This arrangement helps to ensure that each step moves vertically so that the footprint of the installation in its stairway configuration is the same as in its platform configurations.

Follower 19 associated with the bearer 16 for the lowermost step of the stairway, the tread of which step, as can be seen in FIG. 1, is level with lower level 7 in the stairway configuration, is prevented from movement along channel 20 by clips 26. Similarly, follower 21 associated with the uppermost bearer in the stairway configuration is prevented from movement along channel 22 by clips 27. The end of lower stringer 18 associated with this uppermost bearer is pivoted to a bracket 28 on the axis of the uppermost follower 21. Bracket 28 is attached to the distal end of a piston rod of an hydraulic ram adapted to cause the rod to reciprocate vertically. The hydraulic ram is omitted from FIG. 1 for clarity. The reverse configuration in which the ram is mounted to the bracket with its piston rod extending vertically downward is also feasible. Vertical movement of bracket 28 may be guided by a groove and rail arrangement. As the bracket moves downwardly, the followers 19 and 21 (apart from the two that are fixed relative to their channels, as explained above) will slide along their respective channels to maintain the horizontal distance H separating one follower from the next, so that each of the steps moves vertically, until the tread surfaces of all of the steps are level with lower level 7, as shown in FIG. 3. In this configuration the bearers 16, via their rearward extensions 23, make contact with the surface of a frame 29. One or more further hydraulic rams, again omitted for clarity, then raise frame 29, together with the several steps maintained in flat configuration supported thereon, until the tread surfaces of the steps is level with upper level 8. It will be appreciated that as the angle of the stringers to the horizontal changes, so will the separation D between one follower and the next along the channels of the stringers. The ram (not shown for clarity) associated with bracket 28 may operate between the bracket 28 and frame 29 or may be employed together with one or more further rams additionally to move the platform as a whole vertically between the positions shown in FIGS. 3 and 4, so that the platform moves entirely on vertically operating rams without any structure similar to the "scissor-lift" shown in FIG. 4. The frame 29 with the flat platform thereon may be supported on a pair of forks in the manner of a fork-lift truck. A single vertically acting hydraulic ram may control the fork.

The above description is primarily presented on the assumption that the stairway is converted into a platform lift by movement from the first stairway configuration to the second flat configuration, and is then operated as a platform lift to move the platform as a whole between the second and third flat configurations to transport a wheelchair user from the lower to the upper level or vice versa. As already noted above, the alternative arrangement is equally feasible, in which conversion from the first stairway configuration to a flat configuration is to the third configuration in which the tops of the steps are level with the upper level, followed thereafter by movement of the platform lift as a whole. In this arrangement, rather than the second stringer being mounted to a pivot on a bracket on the axis of the second follower of the uppermost step, it would be the first stringer that would be mounted to a pivot on a bracket on the axis of the first follower of the lowermost step.

It will readily be appreciated that the steps of the combined stairway and lift platform installation occupy the same footprint whether in stairway or flat configurations. The hydraulic rams are suitably located in a pit beneath frame 29. An electrically driven hydraulic pump for the rams and a control system therefor are also preferably, but not necessarily, positioned beneath frame 29 with manually operated controls for the installation mounted within reach of a wheelchair user. In an alternative arrangement, there need be no visible manual controls, a wheelchair user operating the system through a wireless connection, for example via a smartphone. In yet another arrangement, a hidden button post 30 (FIG. 2), and which could be physically combined with the left or right barriers 14, may rise automatically upon detection of a wheelchair adjacent the stairway on the lower or upper level.

The combined stairway and lift platform installation may take up the entire width of a stairway. Alternatively, it may comprise part only of the width of a stairway, there being conventional static stairways to left and/or right of the installation.

As will readily be appreciated, when the steps are other than in their first stairway configuration or in their third flat configuration at the upper level, a void will effectively be defined above the steps in the location the steps would occupy in their first stairway configuration. To avoid the danger of someone inadvertently falling into this void, an upper level barrier is preferably provided to selectively prevent access from the upper level into this void. The upper level barrier suitably takes one of two forms. It may comprise a simple doorway mounted to swing about a vertical axis selectively to close off the void from access from the upper level. Alternatively, and preferably, the upper level barrier comprises a raisable barrier 31 located on the upper level 8 and having a first position 32 in which it is hidden from view beneath the upper level when the steps are in their first stairway configuration. The barrier 31 is raised to occupy a second raised position selectively closing off said void from access from the upper level when said void is present.

The invention claimed is:

1. A combined stairway and lift installation, comprising: a plurality of movable steps each including a top surface or tread and a riser; the steps defining:

a first stairway configuration in which the top surfaces of the steps lie in parallel planes, the steps when in the first stairway configuration allowing access from a lower level to an upper level for a person walking up the stairway and access from said upper level to said lower level or a person descending the stairway, the steps in said first stairway configuration defining a first footprint being an area occupied by a vertical geometrical projection of the steps in said first stairway configuration on to a horizontal plane, a second flat configuration in which the top surfaces of all of the steps lie substantially in first common horizontal plane substantially level with said lower level, and define a second footprint in said first horizontal plane, and a third flat configuration in which the top surfaces of all of the steps lie substantially in a second common horizontal plane substantially level with said upper level, and define a third footprint in said second horizontal plane, the second and third footprints being the same as the first footprint, the steps in each of said second and third configurations forming a platform in which support is provided from below for each step across the entire extent of the platform, whereby the platform is load bearing across its entire extent and moveable as a whole as a flat load bearing lift platform vertically up from said second configuration and vertically down from said third configuration;

the installation further comprising a mechanism for moving the steps from the first stairway configuration to a flat configuration selected from said second and third configurations and for moving the steps from the selected flat configuration to the other of the second and third configurations; the mechanism being capable of moving the steps from the first stairway configuration to the said selected flat configuration with each step moving vertically from its position in the first stairway configuration to its position in the selected flat configuration; the mechanism being wholly concealed from view, when the steps are in the first stairway configuration, by an envelope including the treads and risers of all of the steps; wherein the top surface or tread of each step defines a forward edge facing outwardly of the stairway and a rearward edge, and wherein, adjacent each lateral side of the stairway, each step is supported by first and second movable stringers, each step having a respective first follower constrained to follow each first stringer and a respective second follower constrained to follow each second stringer, the stringers and followers forming part of the mechanism;

wherein, adjacent each lateral side of the stairway, the respective first stringer is located vertically higher than the respective second stringer when the steps are in the first stairway configuration and wherein the respective first stringer is located parallel to and vertically at the same level as the respective second stringer when the steps are in the second stairway configuration, the first follower associated with each step being more forwardly located than the second follower associated with the same step.

2. An installation according to claim 1, wherein each stringer is of channel form, the followers being constrained within the channels.

3. An installation according to claim 1, wherein, adjacent each lateral side of the stairway, the first follower of the lowermost step is prevented from movement relative to the first stringer, the second follower of the uppermost step is prevented from movement relative to the second stringer, the second follower of the uppermost step defines a first axis, and the second stringer is mounted to a pivot on a bracket on the said first axis, the bracket being coupled to a hydraulic ram for movement of the bracket vertically to move the steps from the first stairway configuration to the second flat configuration.

4. An installation according to claim 1, wherein, adjacent each lateral side of the stairway, the first follower of the lowermost step is prevented from movement relative to the first stringer, the second follower of the uppermost step is prevented from movement relative to the second stringer, the first follower of the lowermost step defines a second axis, and the first stringer is mounted to a pivot on a bracket on the said second axis, the bracket being coupled to a hydraulic ram for movement of the bracket vertically to move the steps from the first stairway configuration to the third flat configuration.

5. An installation according to claim 1, wherein each step is supported on a pair of bearers, one located adjacent each lateral side of the stairway, each bearer mounting the said first follower and the said second follower of the said step associated with that side of the stairway thereon.

6. An installation according to claim 5, wherein each step includes a riser, and each bearer includes a rearward extension mounting a vertical pin which is slidably received through a guide opening in the bearer of the next higher step, the vertical pin having an upper portion accommodated in space beneath the tread and behind the riser of the next higher step as the steps move from the first stairway configuration to one of the second and third flat configurations.

7. An installation according to claim 1, further comprising an upper level barrier adapted to selectively prevent access from the upper level into a void defined above the steps in their second flat configuration or in configurations of the steps in which the top surfaces thereof serve together as a whole as a flat load bearing lift platform, which platform is located between the second and third flat configurations, the upper level barrier being a raisable barrier located on said upper level and having a first position substantially hidden from view beneath the upper level when the steps are in the first stairway configuration and a second raised position selectively closing off said void from access from the upper level when said void is present.

8. An installation according to claim 1, wherein adjacent each lateral side of the stairway, the respective first stringer is located horizontally offset in a direction along the width of the step from the respective second stringer.

9. An installation according to claim 1, wherein the first and second followers for each step, excluding the first follower of the lowermost step and the second follower of the uppermost step, are each constrained to slide along a respective first stringer or a respective second stringer as the steps move from the first stairway configuration to one of the second and third flat configurations.

10. A method for converting a stairway comprising a plurality of steps each defining a top surface or tread and a riser into a flat load bearing lift platform capable of moving as a whole from one of a lower and an upper level to the other, the lift platform comprising the treads of all of the steps, the method comprising the steps of: employing a mechanism to guide each step of the plurality vertically from a stairway configuration in which the steps form a stairway with the treads in parallel planes enabling access from said lower level to said upper level and from said upper level to said lower level to a flat configuration in which the top surface of each step is substantially in a horizontal plane level with one of the lower and upper levels from which a wheelchair user may wish to travel to the other of the lower and upper levels and all of the steps are supported from below by the mechanism whereby the flat lift platform so formed is load bearing across its entire extent, whereby a wheelchair user may move horizontally from the said one of the lower and upper levels on to the said flat load bearing lift platform defined by the treads of the plurality of steps in the flat configuration, the top surface or tread of each step defining a forward edge facing outwardly of the stairway and a rearward edge, and, adjacent each lateral side of the stairway, each step being supported by first and second movable stringers, each step having a respective first follower constrained to follow each first stringer and a respective second follower constrained to follow each second stringer, the respective first stringer being located vertically higher than the respective second stringer when the steps are in the stairway configuration, and the respective first stringer being located parallel to and vertically at the same level as the respective second stringer when the steps are in the flat configuration, the first follower associated with each step being more forwardly located than the second follower associated with the same step, the stringers and followers forming part of the mechanism, and the mechanism being additionally capable of moving said flat load bearing platform from said one level to the other, the steps in said stairway configuration defining a first footprint being an area occupied by a vertical geometrical projection of the steps in said stairway configuration on to a horizontal plane, the steps in the flat configuration defining a footprint which is the same as said first footprint, and the mechanism being wholly concealed from view, when the stairway is in the stairway configuration, beneath an envelope including the treads and risers of all of the steps.

11. A method of moving a wheelchair user from one of the lower and upper levels to the other of the lower and upper levels comprising: a first method step consisting of a method according to claim 10 for converting a stairway into a flat load bearing lift platform, followed by a second method step of moving the platform defined by the top surfaces of the plurality of steps as a whole vertically from one of the lower and upper levels to the other of the lower and upper levels.

12. A combined stairway and lift installation, comprising: a plurality of movable steps each including a top surface or tread and a riser; the steps defining:

a first stairway configuration in which the top surfaces of the steps lie in parallel planes, the steps when in the first stairway configuration allowing access from a lower level to an upper level for a person walking up the stairway and access from said upper level to said lower level for a person descending the stairway, the steps in said first stairway configuration defining a first footprint being an area occupied by a vertical geometrical projection of the steps in said first stairway configuration on to a horizontal plane, a second flat configuration in which the top surfaces of all of the steps lie substantially in a first common horizontal plane substantially level with said lower level, and define a second footprint in said first horizontal plane, and a third flat configuration in which the top surfaces of all of the steps lie substantially in a second common horizontal plane substantially level with said upper level, and define a third footprint in said second horizontal plane, the second and third footprints being the same as the first footprint, the steps in each of said second and third configurations forming a platform in which support is provided from below for each step across the entire extent of the platform, whereby the platform is load bearing across its entire extent and moveable as a whole as a flat load bearing lift platform vertically up from said second configuration and vertically down from said third configuration;

the installation further comprising a mechanism for moving the steps from the first stairway configuration to a flat configuration selected from said second and third configurations and for moving the steps from the selected flat configuration to the other of the second and third configurations, the mechanism being capable of moving the steps from the first stairway configuration to the said selected flat configuration with each step moving vertically from its position in the first stairway configuration to its position in the selected flat configuration; the mechanism being wholly concealed from view, when the steps are in the first stairway configuration, by an envelope including the treads and risers of all of the steps; wherein the top surface or tread of each step defines a forward edge facing outwardly of the stairway and a rearward edge, and wherein, adjacent each lateral side of the stairway, each step is supported by first and second movable stringers, each step having a respective first follower constrained to follow each first stringer and a respective second follower constrained to follow each second stringer, the stringers and followers forming part of the mechanism;

wherein adjacent each lateral side of the stairway, the respective first stringer is located vertically higher than and horizontally offset in a direction along the width of the step from the respective second stringer when the steps are in the first stairway configuration and wherein the respective first stringer is located parallel to and vertically at the same level as the respective second stringer when the steps are in the second stairway configuration.

13. A combined stairway and lift installation, comprising: a plurality of movable steps each including a top surface or tread and a riser; the steps defining:

a first stairway configuration in which the top surfaces of the steps lie in parallel planes, the steps when in the first stairway configuration allowing access from a lower level to an upper level for a person walking up the stairway and access from said upper level to said lower level for a person descending the stairway, the steps in said first stairway configuration defining a first footprint being an area occupied by a vertical geometrical projection of the steps in said first stairway configuration on to a horizontal plane, a second flat configuration in which the top surfaces of all of the steps lie substantially in a first common horizontal plane substantially level with said lower level, and define a second footprint in said first horizontal plane, and a third flat configuration in which the top surfaces of all of the steps lie substantially in a second common horizontal plane substantially level with said upper level, and define a third footprint in said second horizontal plane, the second and third footprints being the same as the first footprint, the steps in each of said second and third configurations forming a platform in which support is provided from below for each step across the entire extent of the platform, whereby the platform is load bearing across its entire extent and moveable as a whole as a flat load bearing lift platform vertically up from said second configuration and vertically down from said third configuration;

the installation further comprising a mechanism for moving the steps from the first stairway configuration to a flat configuration selected from said second and third configurations and for moving the steps from the selected flat configuration to the other of the second and third configurations; the mechanism being capable of moving the steps from the first stairway configuration to the said selected flat configuration with each step moving vertically from its position in the first stairway configuration to its position in the selected flat configuration; the mechanism being wholly concealed from view, when the steps are in the first stairway configuration, by an envelope including the treads and risers of all of the steps; wherein the top surface or tread of each step defines a forward edge facing outwardly of the stairway and a rearward edge, and wherein, adjacent each lateral side of the stairway, each step is supported by first and second movable stringers, each step having a respective first follower constrained to follow each first stringer and a respective second follower constrained to follow each second stringer, the stringers and followers forming part of the mechanism;

wherein adjacent each lateral side of the stairway, the first follower of the lowermost step is prevented from movement relative to the first stringer, the second follower of the uppermost step is prevented from movement relative to the second stringer, and the upper end of the first stringer is adjacent to the lower end of the forward edge of the uppermost step in the first stairway configuration.

14. A combined stairway and lift installation, comprising: a plurality of movable steps each including a top surface or tread and a riser; the steps defining:

a first stairway configuration in which the top surfaces of the steps lie in parallel planes, the steps when in the first stairway configuration allowing access from a lower level to an upper level for a person walking up the stairway and access from said upper level to said lower level for a person descending the stairway, the steps in said first stairway configuration defining a first footprint being an area occupied by a vertical geometrical projection of the steps in said first stairway configuration on to a horizontal plane, a second flat configuration in which the top surfaces of all of the steps lie substantially in a first common horizontal plane substantially level with said lower level, and define a second footprint in said first horizontal plane, and a third flat configuration in which the top surfaces of all of the steps lie substantially in a second common horizontal plane substantially level with said upper level, and define a third footprint in said second horizontal plane, the second and third footprints being the same as the first footprint, the steps in each of said second and third configurations forming a platform in which support is provided from below for each step across the entire extent of the platform, whereby the platform is load bearing across its entire extent and moveable as a whole as a flat load bearing lift platform vertically up from said second configuration and vertically down from said third configuration;

the installation further comprising a mechanism for moving the steps from the first stairway configuration to a flat configuration selected from said second and third configurations and for moving the steps from the selected flat configuration to the other of the second and third configurations; the mechanism being capable of moving the steps from the first stairway configuration to the said selected flat configuration with each step moving vertically from its position in the first stairway configuration to its position in the selected flat configuration; the mechanism being wholly concealed from view, when the steps are in the first stairway configuration, by an envelope including the treads and risers of all of the steps; wherein the top surface or tread of each step defines a forward edge facing outwardly of the stairway and a rearward edge, and wherein, adjacent each lateral side of the stairway, each step is supported by first and second movable stringers, each step having a respective first follower constrained to follow each first stringer and a respective second follower constrained to follow each second stringer, the stringers and followers forming part of the mechanism;

wherein adjacent each lateral side of the stairway, the first follower of the lowermost step is prevented from movement relative to the first stringer, the second follower of the uppermost step is prevented from movement relative to the second stringer, the upper end of the first stringer is slidably mounted to the first follower of the uppermost step and the lower end of the second stringer is slidably mounted to the second follower of the lowermost step.

* * * * *